US010730287B2

(12) United States Patent
Korthuis et al.

(10) Patent No.: US 10,730,287 B2
(45) Date of Patent: Aug. 4, 2020

(54) FLUID EJECTION FIRE PULSES

(71) Applicant: HEWLETT-PACKARD DEVELOPMENT COMPANY, L.P., Spring, TX (US)

(72) Inventors: Vincent C Korthuis, Corvallis, OR (US); Eric T Martin, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/349,801

(22) PCT Filed: Feb. 23, 2017

(86) PCT No.: PCT/US2017/019185

§ 371 (c)(1),
(2) Date: May 14, 2019

(87) PCT Pub. No.: WO2018/156138

PCT Pub. Date: Aug. 30, 2018

(65) Prior Publication Data

US 2019/0375207 A1 Dec. 12, 2019

(51) Int. Cl.

| | |
|---|---|
| ***B41J 2/045*** | (2006.01) |
| ***B41J 2/20*** | (2006.01) |
| ***B41J 2/17*** | (2006.01) |

(52) U.S. Cl.

CPC ..... *B41J 2/04546* (2013.01); *B41J 2/0453* (2013.01); *B41J 2/0458* (2013.01); *B41J 2/04596* (2013.01); *B41J 2/1707* (2013.01); *B41J 2/20* (2013.01)

(58) Field of Classification Search

CPC ..... B41J 2/0453; B41J 2/20; B41J 2/04596; B41J 2/1707

See application file for complete search history.

(56) References Cited

U.S. PATENT DOCUMENTS

| | | | | |
|---|---|---|---|---|
| 7,441,851 | B2 | 10/2008 | Liou et al. | |
| 8,353,568 | B2 | 1/2013 | Lee | |
| 8,393,714 | B2 | 3/2013 | Silverbrook | |
| 8,632,148 | B2 | 1/2014 | Tabata | |
| 8,894,170 | B2 | 11/2014 | Tabata | |
| 9,028,023 | B2 | 5/2015 | Tabata | |
| 2003/0202024 | A1* | 10/2003 | Corrigan | B41J 2/04506 347/9 |

(Continued)

FOREIGN PATENT DOCUMENTS

| | | |
|---|---|---|
| WO | WO-2014181100 | 11/2014 |
| WO | WO-2016014082 | 1/2016 |

OTHER PUBLICATIONS

The sample delivery of new 600 dpi ink recirculating inkjet printhead "CF3" has started, Jul. 15, 2016,< https://www.toshibatec.com/information/20160715_01.html >.

*Primary Examiner* — Julian D Huffman
(74) *Attorney, Agent, or Firm* — Rathe Lindenbaum LLP

(57) ABSTRACT

A fluid ejection device may include fluid actuators and an actuation controller. Each fluid actuator may have an associated address. The actuation controller is to receive an address for a fluid actuator of the device to be actuated and is further to automatically transmit one of different fire pulses based upon the received address.

13 Claims, 6 Drawing Sheets

(56) References Cited

U.S. PATENT DOCUMENTS

| | | | | |
|---|---|---|---|---|
| 2004/0021710 | A1* | 2/2004 | Hayasaki | G06K 15/1805 347/5 |
| 2008/0001981 | A1* | 1/2008 | Hu | B41J 2/0451 347/9 |
| 2008/0062216 | A1 | 3/2008 | Bergstedt | |
| 2010/0328391 | A1* | 12/2010 | Martin | B41J 2/1753 347/14 |
| 2014/0320557 | A1 | 10/2014 | Matsumoto | |
| 2016/0082724 | A1 | 3/2016 | Date et al. | |
| 2017/0239944 | A1* | 8/2017 | Martin | B41J 2/04543 |

* cited by examiner

FLUID EJECTION FIRE PULSES

BACKGROUND

Fluid ejection devices are used to selectively apply fluid. Fluid ejection devices often include fluid actuators to eject fluid. Some fluid ejection devices additionally include fluid actuators to circulate fluid. Such fluid ejection devices utilize signals, in the form of fire pulses, that control the operation of individual fluid actuators.

DETAILED DESCRIPTION OF EXAMPLES

Figure 1:
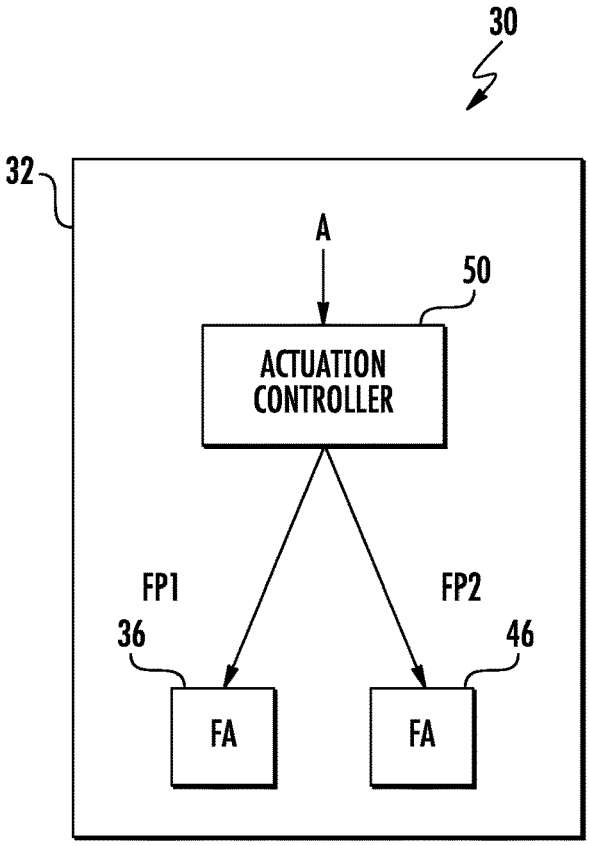
FIG. 1 is a schematic diagram of an example fluid ejection device.

Many fluid ejection devices include ejection fluid actuators for ejecting fluid, such as through a nozzle. Many fluid ejection devices include separate circulation fluid actuators for circulating fluid to fluid ejection chambers or for mixing the fluid to be ejected. With many existing devices, the same fire pulse is used to actuate the ejection fluid actuators and the separate circulation fluid actuators.

Using the same fire pulse to actuate different types of fluid actuators as well as different fluid actuators at different locations on the device may reduce performance of such fluid ejection devices. For example, to eject fluid, the fire pulses transmitted to the ejection fluid actuators may deliver high intensity levels of energy (a high over energy setting). Such high intensity levels of energy may be unnecessary when actuating circulation fluid actuators. As a result, transmission of the same fire pulses to actuate circulation fluid actuators may produce unnecessary heat, heating the print head device to unacceptable levels.

Disclosed herein are example fluid ejection devices, fluid ejection systems and example methods that utilize different fire pulses to actuate different fluid actuators on a fluid ejection device. In one implementation, a first fire pulse may be used to actuate a first type of fluid actuator, such as an ejection fluid actuator, whereas a second fire pulse, different than the first fire pulse, may be used to actuate a second type of fluid actuator, such as a circulation fluid actuator. In one implementation, first fire pulse may be used to actuate fluid actuators at first regions of the device while a second fire pulse, different than the first fire pulse, may be used to actuate fluid actuators located at other regions of the device.

Disclosed herein are example fluid ejection devices, fluid ejection systems and example methods that automatically transmit the different fire pulses to the different fluid actuators based upon the address of the different fluid actuators. In such examples, circuitry or logic on the fluid ejection head device itself automatically determines whether a particular fluid actuator at a particular address should be actuated using a first fire pulse or using a second different fire pulse based upon the address of the particular fluid actuator. In such implementations, fluid ejection instructions or signals transmitted to the device may omit specific instructions as to which of the different fire pulses should be used to actuate the particular fluid actuator at the particular address. As a result, the transmission of fluid ejection instructions to the fluid ejection device consume less bandwidth. In addition, the overall fluid ejection system may be less complex.

Disclosed herein is an example fluid ejection device that may comprise fluid actuators and an actuation controller on a substrate. Each fluid actuator may have an associated address. The actuation controller is to receive an address for a fluid actuator of the device to be actuated and is further to automatically transmit one of different fire pulses based upon the received address.

Disclosed herein is an example method for actuating different fluid actuators on a substrate of a fluid ejection device. The method may comprise receiving, with an actuation controller on the substrate of the fluid ejection device, instructions to actuate a fluid actuator at a given address. The method may further comprise automatically transmitting, with the actuation controller on the fluid ejection device, one of a first fire pulse and a second fire pulse, having different parameters than the first fire pulse, based upon the received address.

Disclosed herein is an example fluid ejection system that may comprise a fluid ejection controller and a fluid ejection device. The fluid ejection controller may transmit instructions to the fluid ejection device, wherein the instructions comprise an address of a fluid actuator on the fluid ejection device to be actuated. The fluid ejection device may comprise fluid actuators and an actuation controller on a substrate. Each fluid actuator may have an associated address. The actuation controller is to receive the address for the fluid actuator of the device to be actuated and is to automatically transmit one of different fire pulses based upon the received address.

FIG. 1 is a schematic diagram of an example fluid ejection device 30. Fluid ejection device 30 comprises substrate 32, fluid actuators 36, 46 and actuation controller 50. Substrate 32 comprises a base or platform that supports fluid actuators 36, 46 and actuation controller 50. In one implementation, substrate 32 may be formed from silicon. In other implementations, substrate 32 may be formed from other materials such as polymers or ceramics. In one implementation, substrate 32 may be part of the fluid ejection die upon which electronic components and circuitry are fabricated.

Fluid actuators 36, 46 comprise devices or elements that selectively apply force to adjacent fluid to drive or move the adjacent fluid. In one implementation, fluid actuators 36 each comprise thermally resistive elements adjacent a volume, wherein the thermally resistive element, upon receiving electrical current, generates a sufficient amount of heat to vaporize fluid so as to create a bubble, wherein the bubble drives fluid from the volume. In one implementation, fluid actuators 36 may comprise a piezo-resistive element that changes shape or size in response to being heated or in response to electrical current, wherein the piezo-resistive element changes shape or size so as to move a membrane to move adjacent fluid. In yet other implementations, fluid actuator 36, 46 may comprise other devices or elements that may be selectively controlled to move fluid.

Fluid actuators 36, 46 are different from one another in at least one aspect such that it is beneficial to actuate or drive fluid actuators 36, 46 with different actuation signals or fire pulses. In one implementation, fluid actuators 36, 46 are similar to one another but for the surrounding environment and function. For example, in one implementation, fluid actuator 36 comprises an ejection fluid actuator, an actuator that is located adjacent an ejection chamber and proximate a nozzle so as to eject or expel fluid within the ejection chamber through the nozzle. In such an implementation, fluid actuator 46 comprises a circulation fluid actuator, an actuator adjacent a volume so as to pump or drive fluid from the volume into the ejection chamber so as to circulate fluid prior to ejection of the fluid. In such an implementation, fluid actuator 36 may benefit from being actuated by a first fire pulse that provide higher intensity energy levels to enhance the ejection of fluid through the nozzle, whereas fluid actor 46 may benefit from being actuated by a second fire pulse that provides relatively lower intensity energy levels sufficient to drive the fluid while reducing generation of excess heat that might otherwise contribute to heating the substrate and supported components to unacceptable levels.

In another implementation, fluid actuators 36, 46 may be different with respect to one another in other respects. For example, in another implementation, fluid actuators 36, 46 may have different drop weights, the amount or volume of fluid ejected or otherwise driven by the fluid actuator. For example, fluid actuator 36 may have a first drop weight fluid actuator 46 has a second different drop weight. With such different drop weights, it may be beneficial to actuate the different fluid actuators with different fire pulses of different durations, intensities or the like. Although fluid ejection device 30 is illustrated as comprising two fluid actuators 36, 46, in other implementations, fluid ejection device 30 may comprise additional fluid actuators at additional different addresses.

Actuation controller 50 comprises actuation logic, hardware, circuitry or other electronics that is to receive an address A. Actuation controller 50 automatically transmits one of different fire pulses to fluid actuator 36, 46 at the received address A based upon the received address A. In other words, depending upon the value for address A, actuation controller 50 will transmit the first fire pulse FP1 or will transmit the second fire pulse FP2, wherein fire pulses FP1 and FP1 have settings or parameters different from one another.

In one implementation, actuation controller 50 comprises logic elements that automatically determine what particular fire pulse should be used for the received or given address A based upon the values of at least one of the bits in the series of bits identifying the address. In another implementation actuation controller 50 may comprise a processing unit that follows instructions on a non-transitory readable medium so as to consult a lookup table associating different fluid actuator addresses with different types of fluid actuators or different assigned fire pulses. For example, in one implementation, each of fluid actuators 36, 46 has an address with a corresponding value within a lookup table and wherein the actuation controller automatically selects either the first fire pulse or the second fire pulse for transmission based upon the value in the look up table corresponding to the received address A. In yet other implementations, actuation controller 50 may comprise other electronics or computer hardware that facilitate the automatic determination of which of multiple available fire pulses should be selected for transmission to a fluid actuator based upon the address of the fluid actuator.

In one implementation in which fluid actuator 36 comprises an ejection fluid actuator and wherein fluid actuator 46 comprises a circulation fluid actuator, actuation controller 50 may automatically transmit a first fire pulse FP1 in response to address A corresponding to fluid actuator 36 so as to provide a higher intensity energy to eject fluid. In response to address A corresponding to fluid actor 46, actuation controller 50 may automatically transmit a second fire pulse FP2 that provides a lower intensity energy, and intensity sufficient to drive and circulate fluid, but less than the higher intensity energy for ejecting fluid. As a result, actuation controller 50 automatically transmits or outputs a fire pulse that is well-suited for the particular fluid actuator to be actuated.

Because actuation controller 50 automatically determines which of the different fire pulses should be transmitted based upon the address of the actuator to be fired, the data packets or instructions transmitted to actuation controller 50 may omit specific instructions identifying what fire pulse should be used. As a result, the transmission of fluid ejection instructions to the fluid ejection device 30 consumes less bandwidth. In addition, the overall fluid ejection system utilizing fluid ejection device 30 may be less complex.

Figure 2:
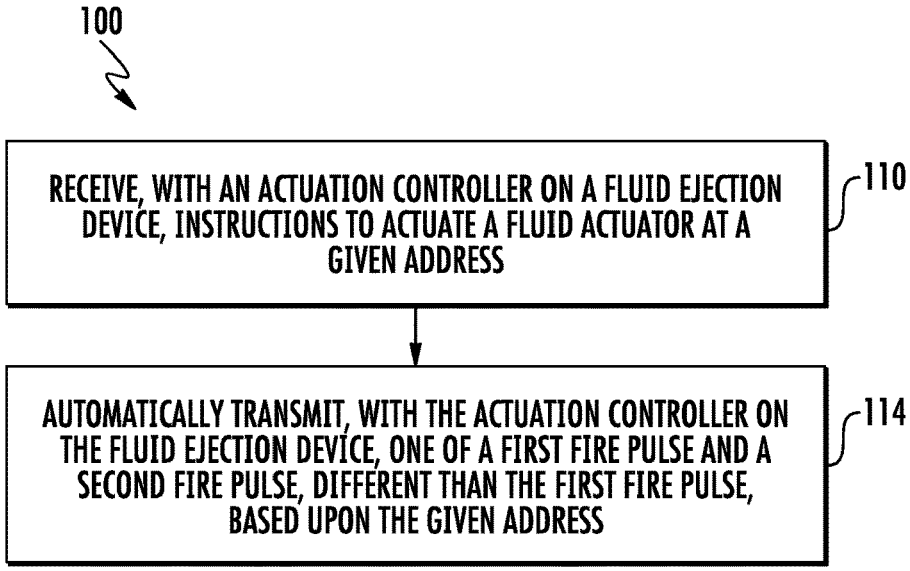
FIG. 2 is a flow diagram of an example method for controlling actuation of fluid actuators on a fluid ejection device.

FIG. 2 is a flow diagram of an example method for actuating fluid actuators on a fluid ejection device or die. Method 100 is described as being carried out with respect to fluid ejection device 30. However, it should be appreciated that method 100 may likewise be carried out with any of the fluid ejection devices and fluid ejection systems described hereafter. Moreover, method 100 may likewise be carried out with other similar fluid ejection devices or fluid ejection systems.

As indicated by block 110, actuation controller 50, on substrate 32 of fluid ejection device 30, receives instructions to actuate a fluid actuator 36, 46 at a given address A.

As indicated by block 114, actuation controller 50 automatically transmits one of a first pulse and a second fire pulse, having different parameters than the first fire pulse, based upon the given address A. In other words, depending upon the value for address A, actuation controller 50 will transmit the first fire pulse FP1 or will transmit the second fire pulse FP2, wherein fire pulses FP1 and FP1 are different from one another. The transmission of the first fire pulse or the second fire pulse is based on the address itself and not based upon any instructions transmitted from a source remote from fluid ejection device 30 that specify what specific fire pulse is to be transmitted. Because such a determination is made on substrate 32 of fluid ejection device 30 itself, the instructions transmitted from the remote source to fluid ejection device 30 may be shorter in length or consume fewer clock cycles or bandwidth.

Figure 3:
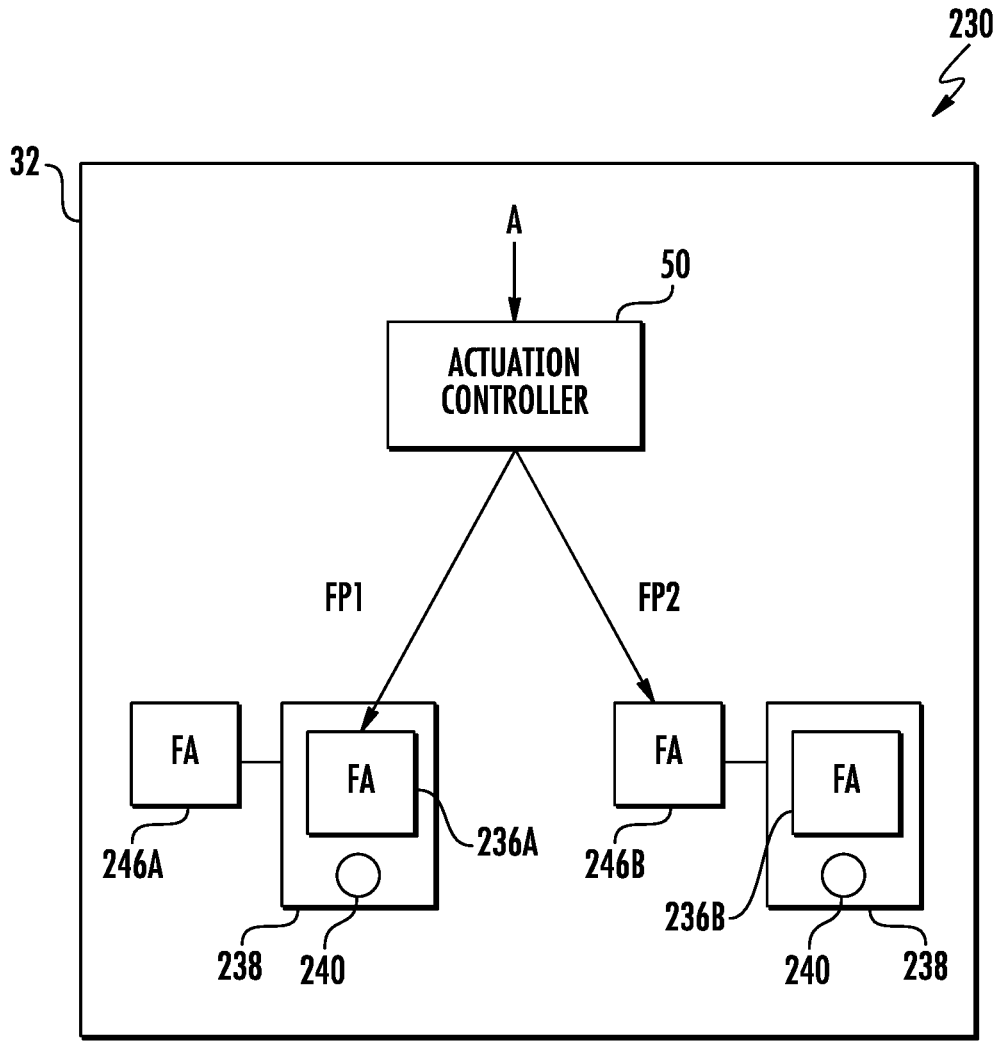
FIG. 3 is a schematic diagram of another example fluid ejection device.

FIG. 3 is a schematic diagram illustrating another example fluid ejection device 230. Fluid ejection device 230 is similar to fluid ejection device 30 described above except that fluid ejection device 230 is specifically illustrated as comprising ejection fluid actuators 236A, 236B (collectively referred to as fluid actuators 236) and circulation fluid actuators 246A, 246B (collectively referred to as fluid actuators 246). Those remaining components of fluid ejection device 230 which correspond to components of fluid ejection device 30 are numbered similarly.

Ejection fluid actuators 236 are similar to actuator 36 described above. Ejection fluid actuators 236 move or drive fluid within an ejection chamber 238 so as to eject the fluid through an associated nozzle 240. Ejection fluid actuators 236 may benefit from a fire pulse that delivers a higher intensity energy or has a high over energy setting to facilitate ejection of the fluid through the nozzle 240. For example, ejection fluid actuator 236 may benefit from a fire pulse having a longer duration.

Circulation fluid actuators 246 are similar to actuator 46 described above. Circulation fluid actuators move or drive fluid so as to mixer circulate the fluid. In the example illustrated, fluid actuators 246A and 246B drive fluid into the ejection chambers 238 of fluid actuators 236A and 236B, respectively. Fluid actuator 246 assist in maintaining fresh fluid within ejection chambers 238 and assist in inhibiting settling in such fluids. Fluid actuators 246 may satisfactorily perform at lower energy levels or fire pulses for shorter durations as compared to the fire pulses having the high over energy settings for the ejection of fluid by fluid actuators 236.

Actuation controller 50 is similar to actuation controller 50 described above with respect to fluid ejection device 30 and method 100. Actuation controller 50 automatically transmits one of different fire pulses to fluid actuator 236, 246 at the received address A based upon the received address A. In other words, depending upon the value for address A, actuation controller 50 will transmit the first fire pulse FP1 or will transmit the second fire pulse FP2, wherein fire pulses FP1 and FP1 have different parameters or settings with respect to one another.

In the example illustrated in which fluid actuators 236 comprises an ejection fluid actuator and wherein fluid actuator 246 comprises a circulation fluid actuator, actuation controller 50 may automatically transmit a first fire pulse FP1 in response to address A corresponding to fluid actuator 236 so as to provide a higher intensity energy to eject fluid. In response to address A corresponding to fluid actor 246, actuation controller 50 may automatically transmit a second fire pulse FP2 that provides a lower intensity energy, and intensity sufficient to drive and circulate fluid, but less than the higher intensity energy for ejecting fluid. As a result, actuation controller 50 automatically transmits or outputs a fire pulse that is well-suited for the particular fluid actuator to be actuated.

Because actuation controller 50 automatically determines which of the different fire pulses should be transmitted based upon the address of the actuator to be fired, the data packets or instructions transmitted to actuation controller 50 may omit specific instructions identifying what fire pulse should be used. As a result, the transmission of fluid ejection instructions to the fluid ejection device 30 consumes less bandwidth. In addition, the overall fluid ejection system utilizing fluid ejection device 30 may be less complex.

Figure 4:
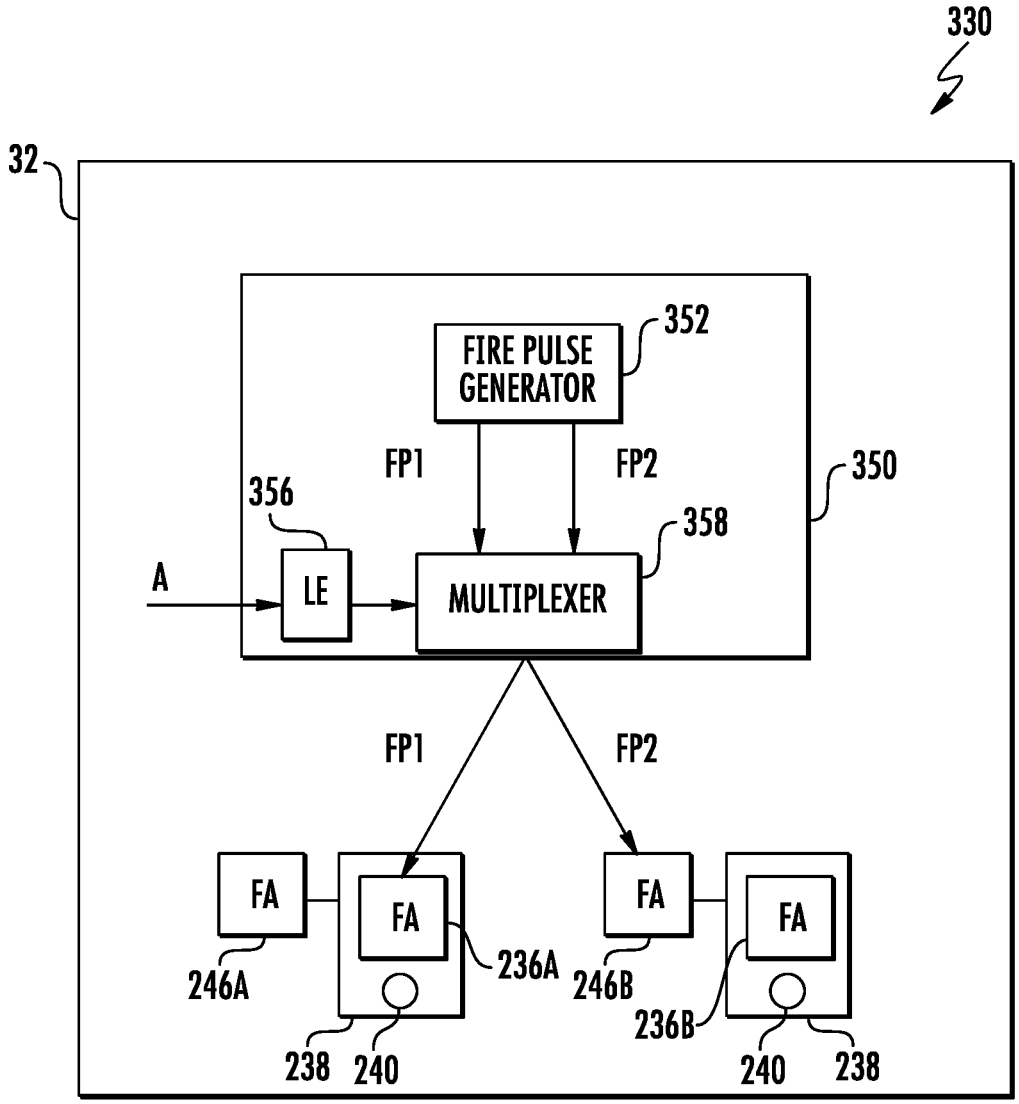
FIG. 4 is a schematic diagram of another example fluid ejection device.

FIG. 4 is a schematic diagram of another example fluid ejection device 330. Fluid ejection device 330 is similar to fluid ejection device 230 described above except that fluid ejection device 330 is specifically illustrated as comprising actuation controller 350, an example implementation of actuation controller 50. Those remaining components of fluid ejection device 330 which correspond to components of fluid ejection device 230 are numbered similarly.

As shown by FIG. 4, actuation controller 350 comprises fire pulse generator 352, logic element 356 and multiplexer 358. Fire pulse generator 352 comprises circuitry formed upon substrate 32 that is to generate different fire pulses, fire pulses having different characteristics or parameters, such as duration. In the example illustrated, fire pulse generator 352 generates a first fire pulse FP1 suitable for an ejection fluid actuator and a second fire pulse FP2 suitable for a circulation fluid actuator. In one implementation, fire pulse FP1 may have a longer duration fire pulse provide a higher intensity of energy to facilitate the ejection of fluid through nozzle. In such an implementation, the second fire pulse FP2 may have a shorter duration fire pulse, as compared to fire pulse FP1, sufficient to move or drive fluid for circulation but providing lower levels of energy so as to reduce possible overheating of device 330. The two fire pulses FP1 and FP2 are transmitted to multiplexer 358. In other implementations, fire pulse generator 352 may generate greater than two different fire pulses offering greater than two different fire pulse characteristics for selective transmission to different fluid actuators based upon the address of such fluid actuators.

Logic element 356 comprises an element, such as a logic gate, that receives address A of a fluid actuator to be actuated and determines if the address is for a fluid actuator that is an ejection fluid actuator or a fluid actuator that is a circulation fluid actuator. In one implementation, logic element 356 makes such a determination based upon a series of binary digits or bits representing or containing the address. In one implementation, logic element 356 makes such a determination based upon a least significant bit of the series of bits. For example, in one implementation, circulation fluid actuators are located at even-numbered addresses, wherein logic element 356 determines that an address having a least significant bit of zero corresponds to an address of a circulation fluid actuator. In another implementation, circulation fluid actuators may be located at odd-numbered addresses, wherein logic element 356 determines that an address having a least significant bit of one is for a circulation fluid actuator. In yet another implementation, each of the circulation fluid actuators may have a first value in a particular bit of every received address and wherein each of the ejection fluid actuators may have a second value in the particular bit of every received address, wherein logic element 356 determines whether the addresses for an ejection fluid actuator or a circulation fluid actuator based upon the value of the particular bit in the address. In yet another implementation, logic element 356 may comprise a processing unit that follows instructions on a non-transitory readable medium so as to consult a lookup table associating different fluid actuator addresses with different types of fluid actuators or different assigned fire pulses. Logic element 356 transmits a signal indicating the determination to multiplexer 358.

Multiplexer 358 comprises an electronic device that selects one of the fire pulses FP1 and FP2 for transmission. Multiplexer 358 makes the selection of one of the fire pulses FP1 and FP2 for transmission based upon such signals from logic element 356. As illustrated by the annotations in FIG. 4, in response to a determination by logic element 356 that the address is for an ejection fluid actuator 236, multiplexer 358 transmits fire pulse FP1 and in response to the logic element 356 that the addresses for a circulation fluid actuator 246, multiplexer 358 transmits fire pulse FP2.

Figure 5:
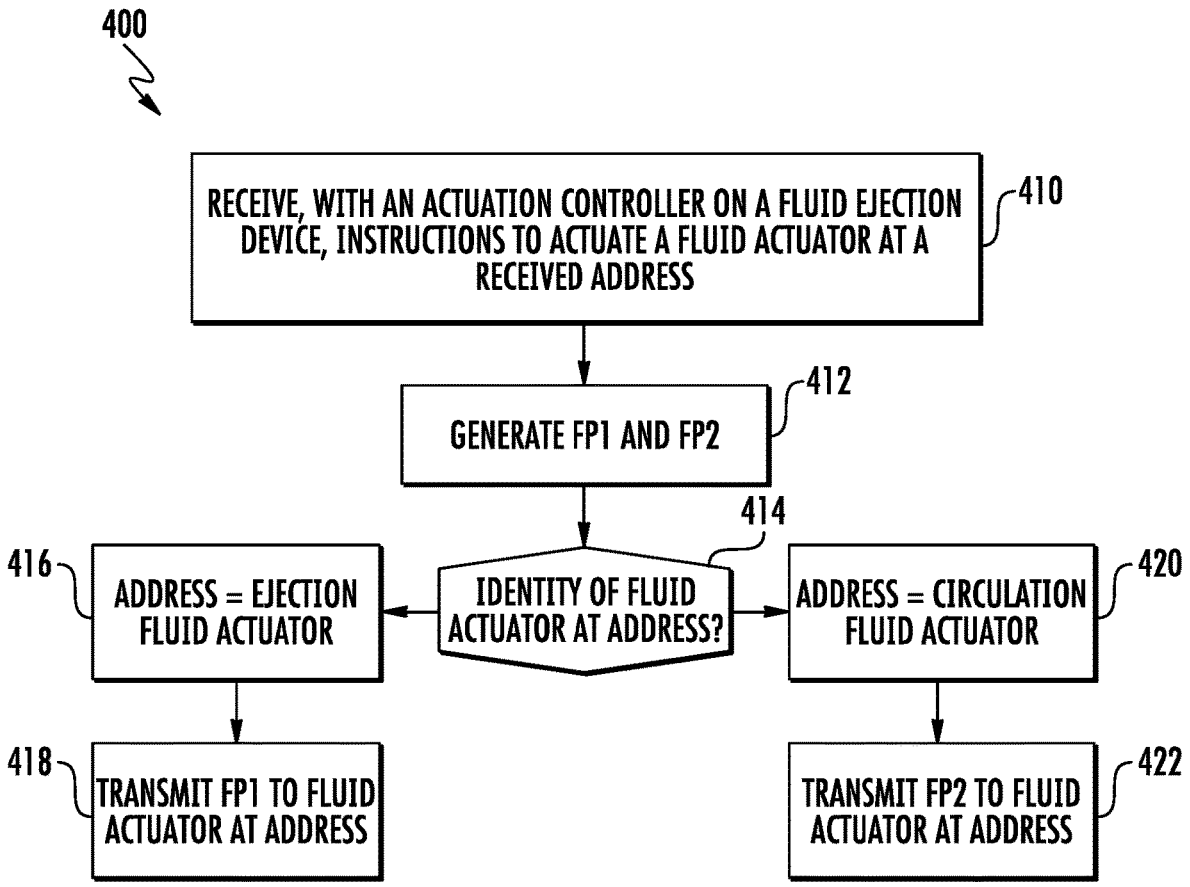
FIG. 5 is a flow diagram of another example method for controlling actuation of fluid actuators on a fluid ejection device.

FIG. 5 is a flow diagram of an example method 400 for actuating fluid actuators on a fluid ejection device. The method 400 is described as being carried out by fluid ejection device 330. However, it should be appreciated that method 400 may likewise be carried out with any of the fluid ejection devices and fluid ejection systems described in this disclosure. Moreover, method 400 may likewise be carried out with other similar fluid ejection devices or fluid ejection systems.

As indicated by block 410, logic element 356 of actuation controller 350, on substrate 32 of fluid ejection device 330, receives instructions to actuate a fluid actuator 236, 246 at a given or received address A.

As indicated by block 412, fire pulse generator 352 generates different fire pulses, fire pulse having different characteristics such as different durations or duty cycles (in the case of a multi-pulse fire signal). In the example illustrated, fire pulse generator 352 generates a first fire pulse FP1 suitable for an ejection fluid actuator and a second fire pulse FP2 suitable for a circulation fluid actuator. In one implementation, fire pulse FP1 may have a longer duration fire pulse provide a higher intensity of energy to facilitate the ejection of fluid through nozzle. In such an implementation, the second fire pulse FP2 may have a shorter duration fire pulse, as compared to fire pulse FP1, sufficient to move or drive fluid for circulation but providing lower levels of energy so as to reduce possible overheating of device 330.

As indicated by block 414, logic element 356 determines the identity or type of fluid actuator at the particular received address A. in the example illustrated, logic element 356 determines whether address A corresponds to a fluid actuator that is an ejection fluid actuator or is a circulation fluid actuator. The determination is transmitted to multiplexer 358.

As indicated by blocks 416 and 418, in response to logic element 356 outputting a signal indicating that the address is an address of an ejection fluid actuator, multiplexer 358 transmits the first fire pulse FP1 to the fluid actuator at the particular address. As indicated by blocks 420 and 422, in response to logic element 356 outputting a signal indicating that the address is an address of a circulation fluid actuator, multiplexer 358 transmits the second fire pulse FP2 to the fluid actuator at the particular address.

Although method 400 is described as transmitting different fire pulses of different parameters or settings to different fluid actuators based upon whether the address received in block 410 corresponds to an address of an ejection fluid actuator or a circulation fluid actuator, in other implementations, method 400 may involve the transmission of different fire pulses of different parameters or settings to different fluid actuators that are different with respect to one another in other respects. For example, in blocks 416 and 420, logic element 356 may determine whether the address of the fluid actuator received in block 410 corresponds to an address of a fluid actuator having a first drop weight or corresponds to an address of a fluid actuator having a second drop weight different than the first drop weight. It should further be appreciated that although method 400 is described as transmitting one of two different generated fire pulses to different fluid actuators based upon the address received in block 410, in other implementations, method 400 may likewise be carried out with more than two different types of fluid actuators, wherein method 400 involve the transmission of one of more than two different generated fire pulses to different fluid actuators based upon the address received in block 410.

Figure 6:
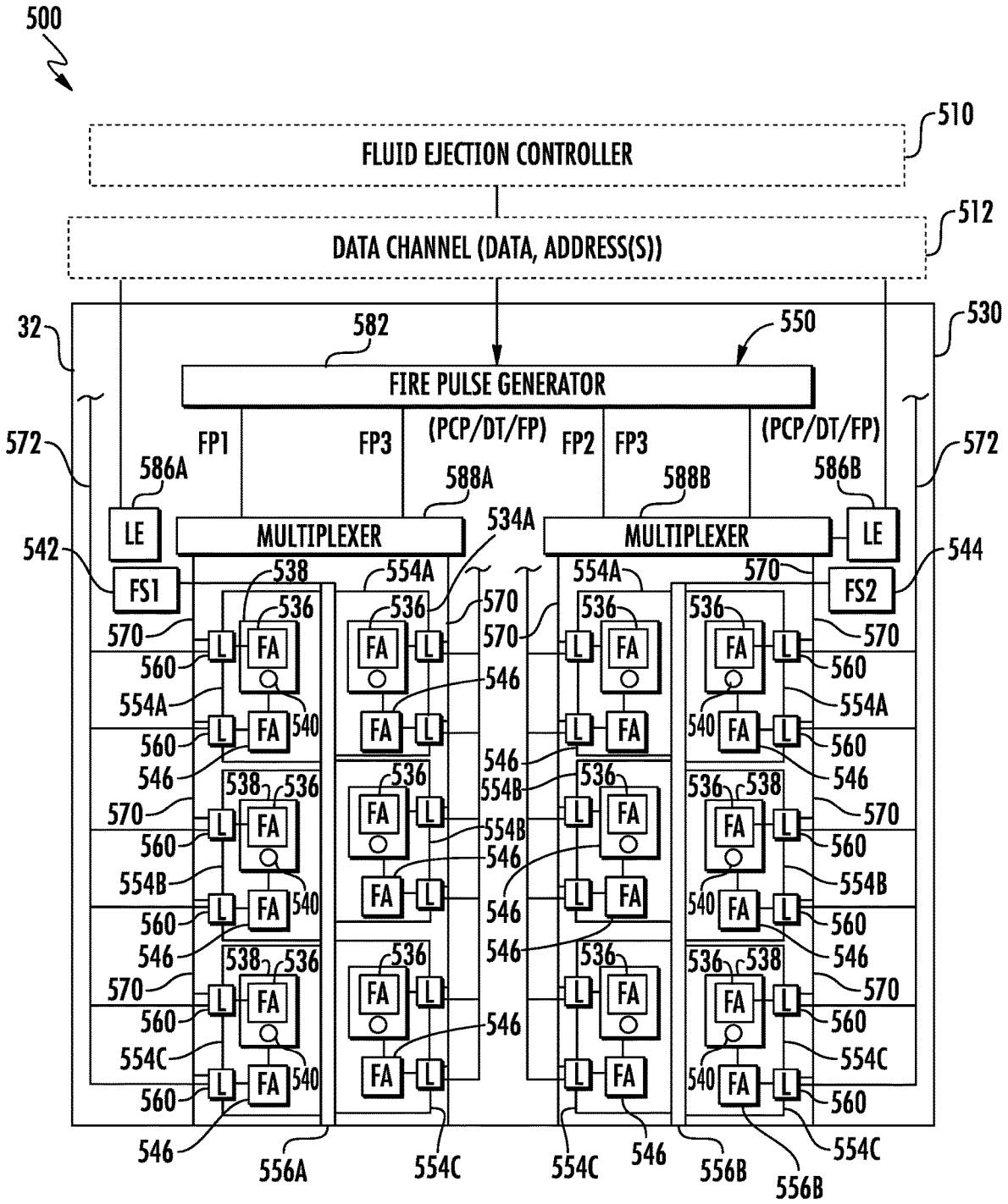
FIG. 6 is a schematic diagram of an example fluid ejection system having another example fluid ejection device.

FIG. 6 is a schematic diagram of an example fluid ejection system 500. Fluid ejection system 500 comprises fluid ejection controller 510 and fluid ejection device 530. Fluid ejection controller 510 comprises electronics, such as a processing unit and an associated non-transitory computer-readable medium, that provides instructions for directing the processing unit. Fluid ejection controller 510 is remote from fluid ejection device 530. Fluid ejection controller 510 transmits image packets to fluid ejection device 530 (as well as other fluid ejection devices 530) in a wired or wireless fashion.

In the example illustrated, the fluid actuators are grouped into sets or primitives of multiple fluid actuators with each group having the same set of individual fluid actuator addresses. Fluid ejection controller 510 transmits the image packets across a data channel 512. The image packets may include addresses and data. The addresses indicate which particular address of each group or primitive is being addressed by the image packet. The data indicates which group or primitive is to be turned on or actuated such that the fluid actuator at the address is actuated or fired. For a particular fluid actuator to be actuated, the fluid actuator must be at the address and must be part of the primitive to be turned on or actuated as indicated by the data. Fluid actuators at the address in those primitives that are not turned on or actuated, pursuant to the data, are not fired or actuated. In one implementation, fluid ejection controller 510 is part of a self-contained ejection system, wherein fluid ejection controller 510 and fluid ejection device 530 are part of a self-contained unit within a single housing.

As with fluid ejection devices 30, 230 and 330 described above, fluid ejection device 530 automatically transmits one of multiple available fire pulses to a fluid actuator based upon instructions from fluid ejection controller 510 indicating the address of the fluid actuator to be actuated. As a result, the data packets or instructions transmitted to fluid ejection device 530 from fluid ejection controller 510 may omit specific instructions identifying what fire pulse should be used, consuming less bandwidth. In addition, the fluid ejection system 500 may be less complex.

Fluid ejection device 530 comprises substrate 32, ejection fluid actuators 536, circulation fluid actuators 546, fluid sources 542, 544 and actuation controller 550. Substrate 32 is described above. Substrate 32 supports the remaining components of fluid ejection device 530. In one implementation, substrate 32 forms the foundation of an individual fluid ejection die.

Ejection fluid actuators 536 are similar to actuators 236 described above. Ejection fluid actuators 236 move or drive fluid within an ejection chamber 538 so as to eject the fluid through an associated nozzle 540. Ejection fluid actuators 536 may benefit from a fire pulse that delivers a higher intensity energy or has a high over energy setting to facilitate ejection of the fluid through the nozzle 540. For example, ejection fluid actuator 236 may benefit from a fire pulse having a longer duration.

Circulation fluid actuators 546 are similar to actuator 246 described above. Circulation fluid actuators 546 move or drive fluid so as to mix or circulate the fluid. In the example illustrated, fluid actuators 546 drive fluid into the ejection chambers 538 of fluid actuators 536. Fluid actuator 546 assist in maintaining fresh fluid within ejection chambers 238 and assist in inhibiting settling in such fluids. Fluid actuators 546 may satisfactorily perform at lower energy levels or fire pulses for shorter durations as compared to the fire pulses having the high over energy settings for the ejection of fluid by fluid actuators 536.

As indicated by broken lines, fluid actuators 536 and 546 are grouped into sets or primitives 554A, 554B, 554C (collectively referred to as primitives 554) along each side of fluid supply slots 556A, 556B. Each of primitives 554 includes multiple ejection fluid actuators 536 and associated circulation fluid actuators 546. However, for ease of illustration, a single ejection fluid actuator 536 and a single circulation fluid actuator 554 are illustrated for each of primitives 554. Although fluid ejection device 530 is illustrated as having three groupings of fluid actuators or three primitives 554 along each side of the associated slot 556, it should be appreciated that fluid ejection device 530 may include a greater or fewer of such primitives along each side of each of slots 554.

The fluid actuators 536 of primitives 554 along fluid supply slot 556A apply fluid from fluid source 542 that is supplied through slot 556A. The fluid actuators 536 of primitives 554 along fluid supply slot 556B apply fluid from fluid source 544 that is supplied through slot 556B. In one implementation, fluid sources 542 and 544 supply different types of fluid having different material properties or characteristics. In one implementation, fluid supply 542 supplies a cyan, magenta or yellow ink whereas fluid supply 544 supplies a black ink. The different fluids supplied by fluid supply 542 and 544 may have different material properties such that the ejection of the different fluids by their respective ejection fluid actuators may be enhanced through the use of different fire pulses, fire pulse having different parameters or settings. In other implementations, fluid supply 542 and 544 may supply other different fluids with different material properties, wherein the ejection of the different fluids by their respective ejection fluid actuators may be enhanced the usage of different fire pulses having different parameters or settings.

Although fluid ejection device 530 is illustrated as having slots 556 that supply fluid from their respective fluid supply 542 and 544 to the circulation fluid actuators 546 which deliver the fluid to the ejection chambers 538 of the ejection fluid actuators 536, in other implementations, fluid may be delivered to circulation fluid actuators 546 through fluid feed holes or other fluid delivery channels or passages. For example, in some implementations, circulation fluid actuators 546 may have individual assigned fluid supply holes or passages. In other implementations, circulation fluid actuators 546 may be arranged in multiple groups or clusters, wherein each group or cluster receives fluid through a dedicated fluid supply passage.

Figure 7:
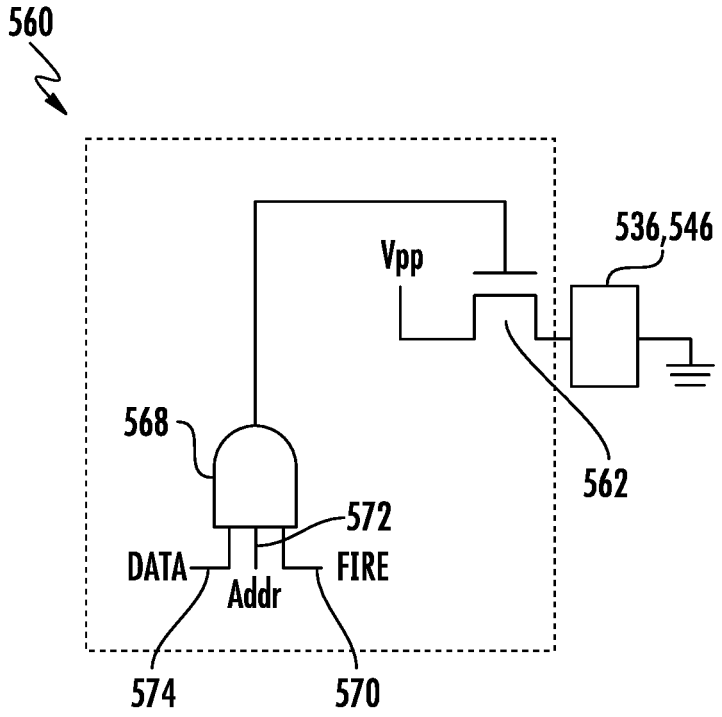
FIG. 7 is a schematic diagram of an example fluid actuator logic element of the fluid ejection device of FIG. 6.

As further shown by FIG. 6, each fluid actuator 536, 546 has an associated fluid actuator logic circuit (L) 560. FIG. 7 is an enlarged circuit diagram illustrating an example logic circuit 560. Each logic circuit 560 controls the turning on and turning off of the fluid actuator 536, 546.

In the example illustrated, FIG. 7 shows logic circuit 560 may comprise a transistor 562 and an AND logic circuitry or gate 568 (schematically illustrated). Transistor 562 is a switch selectively transmitting a voltage Vpp to fluid actuator 536, 546 in response to a signal received from AND logic circuitry or gate 568. The AND logic gate 568 transmits the control signals or fire pulse signal received from line 570 to the gate of transistor 562 in response to receiving an address signal from address line 572 and also receiving a data signal from the data line 574. Address line 572 communicates an address signal from when the particular fluid actuator 536, 546 at the selected address is to be enabled for possibly firing. In the example illustrated, each fluid driver address of each of primitives 546 is connected to a single transmission line 572. For example, a single transmission line 572 may extend into connection with the same fluid driver address in each of the primitives 546 of a group of primitives (all the primitives having fluid actuators connected to the same line 572).

Data line 574 receives a data signal when the particular primitive 546 is to be enabled for firing. In the example illustrated, each of the logic elements 560 of an individual primitive 546 are connected to an assigned data line 574. Enabling signals must be received from both address line 572 and data line 574 for logic circuit 560 to fire the fluid actuator 536, 546 in accordance with the fire pulse received on line 570.

Actuation controller 550 resides on substrate 32 and comprises fire pulse generator 582, logic elements 586A, 586B (collectively referred to as logic elements 586) and multiplexers 588A, 588B (collectively referred to as multiplexers 588). Fire pulse generator 582 comprises circuitry formed upon substrate 32 that is to generate different fire pulses FP1, FP2 and FP3, fire pulses having different characteristics. In the example illustrated, fire pulse generator 550 generates a first fire pulse FP1 suitable for an ejection fluid actuator to eject the fluid supplied by fluid source 542, a second fire pulse FP2 suitable for an ejection fluid actuator to eject the fluid supplied by fluid source 544 and a third fire pulse FP3 suitable for a circulation fluid actuator.

In one implementation, fire pulses FP1 and FP2 may have a longer duration fire pulse as compared to FP3 to provide a higher intensity of energy to facilitate the ejection of fluid through a nozzle. In such an implementation, the third fire pulse FP3 may have a shorter duration fire pulse, as compared to fire pulses FP1 and FP2, sufficient to move or drive fluid for circulation but providing lower levels of energy so as to reduce possible overheating of device 530. In one implementation, fire pulse FP2 may have a longer duration as compared to fire pulse FP2 to provide a higher intensity of energy to better facilitate the ejection of the fluid supplied by fluid source 544. In one implementation in which the fluid supply by fluid source 542 comprises an ink, such as a cyan, magenta or yellow ink and in which the fluid supplied by fluid source 544 comprises a black ink, fire pulse FP3 may have a longer duration as compared to fire pulse FP2 to provide a higher intensity of energy to better facilitate the ejection of the fluid supplied by fluid source 544.

As further shown by FIG. 6, in one implementation, each of the fluid actuators 536, 546 comprise a thermal resistive fluid actuator, wherein each fire pulse is part of a fire pulse train comprising a precursor pulse (PCP) that pre-warms the thermal resistor, a dead time (DT) and the fire pulse itself FP. In the example illustrated, fire pulse generator 550 transmits the first fire pulse FP1 and the third fire pulse FP3 to multiplexer 588A which is connected to those actuators that deliver fluid from fluid source 542. Fire pulse generator 550 transmits the second fire pulse FP2 and the third fire pulse FP3 to multiplexer 588B which is connected to those actuators that deliver fluid from fluid source 544. In other implementations, fire pulse generator 352 may generate greater than three different fire pulses offering greater than three different fire pulse characteristics for selective transmission to different fluid actuators based upon the address of such fluid actuators.

Each of logic elements 586 comprises an element, such as a logic gate, that receives address A of a fluid actuator to be actuated and determines if the address is for a fluid actuator that is an ejection fluid actuator or a fluid actuator that is a circulation fluid actuator. In one implementation, logic element 586 makes such a determination based upon a series of binary digits or bits representing or containing the address. In one implementation, logic element 586 makes such a determination based upon a least significant bit of the series of bits. For example, in one implementation, circulation fluid actuators are located at even-numbered addresses, wherein logic element 586 determines that an address having a least significant bit of zero corresponds to an address of a circulation fluid actuator. In another implementation, circulation fluid actuators may be located at or-numbered addresses, wherein logic element 586 determines that an address having a least significant bit of one is for a circulation fluid actuator. In yet another implementation, each of the circulation fluid actuators may have a first value in a particular bit of the address and wherein each of the ejection fluid actuators may have a second value in the particular bit of the address, wherein logic element 586 determines whether the addresses for an ejection fluid actuator or a circulation fluid actuator based upon the value of the particular bit in the address. Logic elements 586A, 586B transmit a signal indicating the determination to the associated multiplexer 588A, 588B.

Multiplexers 588 comprise electronic devices that select one of the received fire pulses for transmission. Multiplexer 558A makes the selection of one of the fire pulses FP1 and FP3 for transmission based upon such signals from logic element 586A. Multiplexer 558A makes the selection of one of the fire pulses FP2 and FP3 for transmission based upon such signals from logic element 586B. The selected fire pulses by the different multiplexers 588 are transmitted along lines 572 to the logic circuits 560 of the different fluid actuators 536, 546. Although FIG. 6 illustrates FP1 and FP3 connected to multiplexer 588A, and FP2 and FP3 connected to multiplexer 588B, in other implementations, such multiplexers 588 may be replaced with "super-mux" that has as inputs FP1-N, and has as outputs in the form of a fire signal per column or actuators. As described above with respect to logic circuit 560, the individual fluid actuator 536, 546 is actuated in response to both a signal on address line 572 selecting the address of the individual actuator 536, 546 and a signal on data line 574 selecting the primitive containing the individual fluid actuator 536, 546 for firing. Such actuation is pursuant to the fire pulse or the fire pulse train being transmitted along line 570 from the associated multiplexer 588A, 588B.

Although the present disclosure has been described with reference to example implementations, workers skilled in the art will recognize that changes may be made in form and detail without departing from the spirit and scope of the claimed subject matter. For example, although different example implementations may have been described as including one or more features providing one or more benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. A fluid ejection device comprising:

a substrate;

fluid actuators on the substrate, each fluid actuator having an associated address, wherein the fluid actuators comprise:

ejection fluid actuators of ejectors to eject fluid through nozzles; and circulation fluid actuators to circulate fluid with respect to the ejectors; and an actuation controller on the substrate, the actuation controller to:

receive an address for a fluid actuator of the device to be actuated; and automatically transmit one of different fire pulses based upon the to be received address, wherein a first fire pulse is to be automatically transmitted in response to the to be received address corresponding to an address of one of the ejection fluid actuators and wherein a second fire pulse is to be automatically transmitted in response to the to be received address corresponding to an address of one of the circulation fluid actuators.

2. The fluid ejection device of claim 1, wherein the actuation controller is to generate both the first fire pulse for the ejection fluid actuators and the second fire pulse for the circulation fluid actuators prior to reception of the address.

3. The fluid ejection device of claim 2, wherein actuation controller comprises:

a fire pulse generator to generate the first fire pulse and the second fire pulse;

on device logic elements to receive the address for the fluid actuator of the device to be actuated, to determine if the address is for one of the ejection fluid actuators or for one of the circulation fluid actuators and to output a signal based upon the determination; and a multiplexer to transmit one of the first fire pulse and the second fire pulse based upon the signal.

4. The fluid ejection device of claim 1, wherein each of the circulation fluid actuators and the ejection fluid actuators has an address with a corresponding value within a lookup table and wherein the actuation controller automatically selects either the first fire pulse or the second fire pulse for transmission based upon the value in the look up table corresponding to the received address.

5. The fluid ejection device of claim 1, wherein the address of each of the circulation fluid actuators has a first value in a bit of the address, wherein the address of each of the ejection fluid actuators has a second value in the bit of the address and wherein the actuation controller automatically selects either the first fire pulse or the second fire pulse for transmission based upon the bit.

6. The fluid ejection device of claim 1, wherein the ejection fluid actuators and the circulation fluid actuators are associated with ejection of a first fluid, the fluid ejection device further comprising:

second ejection fluid actuators and second circulation fluid actuators associated with ejection of a second fluid different than the first fluid, wherein the actuation controller is to:

generate a third fire pulse, different than the first fire pulse and the second fire pulse, for the second ejection fluid actuators and a fourth fire pulse, different than the first fire pulse, the second fire pulse in the third fire pulse, for the second circulation fluid actuators;

receive a second address for one of the second ejection fluid actuators and the second circulation fluid actuators to be actuated; and automatically select one of the third fire pulse and the fourth fire pulse for transmission based upon the received second address.

7. The fluid ejection device of claim 1, wherein a first one of the fire pulses heats the device to a first extent and wherein a second one of the fire pulses heats the device to a second extent less than the first extent.

8. The fluid ejection device of claim 1, wherein the fluid actuators comprise:

first ejection fluid actuators, each of the first ejection fluid actuators having a first drop weight; and second ejection fluid actuators, each of the second ejection fluid actuators having a second drop weight different than the first drop weight, wherein a first fire pulse is automatically transmitted in response to the received address corresponding to an address of one of the first ejection fluid actuators and wherein a second fire pulse is automatically transmitted in response to the received address corresponding to an address of one of the second ejection fluid actuators.

9. A method comprising:

receiving instructions, with an actuation controller on a substrate of a fluid ejection device, the fluid ejection device comprising ejection fluid actuators of ejectors to eject fluid through nozzles; and circulation fluid actuators to circulate fluid with respect to the ejectors, the instructions to actuate a fluid actuator on the substrate at a given address; and automatically transmitting, with the actuation controller on the fluid ejection device, one of a first fire pulse and a second fire pulse, different than the first fire pulse, based upon the given address, wherein the automatically transmitting comprises automatically transmitting the first fire pulse in response to the given address corresponding to an address of one of the ejection fluid actuators and automatically transmitting the second fire pulse in response to the given address corresponding to an address of one of the circulation fluid actuators.

10. The method of claim 9 further comprising generating, with the actuation controller on the fluid ejection device, the first fire pulse and the second fire pulse prior to receiving the instructions to actuate the fluid actuator at the given address, wherein the automatically transmitting comprises automatically transmitting one of the previously generated first fire pulse and the second fire pulse to the fluid actuator at the given address based upon the given address.

11. The method of claim 10, further comprising determining whether the given address is for one of the ejection fluid actuators or for one of the circulation fluid actuators with on device logic elements that output a signal based upon the determination, wherein the automatically transmitting comprises automatically transmitting the one of the previously generated first fire pulse and the second fire pulse is automatically transmitted to the fluid actuator at the given address by a multiplexer in response to the signal.

12. The method of claim 9, wherein the second fire pulse heats the device to a first extent and wherein the second fire pulse heats the device to a second extent less than the first extent.

13. A fluid ejection system comprising:

a fluid ejection controller to transmit instructions to a fluid ejection device, the instructions comprising an address of a fluid actuator on the fluid ejection device to be actuated; and the fluid ejection device comprising:

a substrate;

fluid actuators on the substrate, each fluid actuator having an associated address, the fluid actuators comprising ejection fluid actuators of ejectors to eject fluid through nozzles and circulation fluid actuators to circulate fluid with respect to the ejectors; and an actuation controller on the substrate, the actuation controller to:

receive the address for the fluid actuator of the device to be actuated; and automatically transmit one of different fire pulses based upon the received address, wherein a first fire pulse is to be automatically transmitted in response to the received address corresponding to an address of one of the ejection fluid actuators and wherein a second fire pulse is to be automatically transmitted in response to the received address corresponding to an address of one of the circulation fluid actuators.

* * * * *